US009353588B2

(12) United States Patent
Heijnen et al.

(10) Patent No.: US 9,353,588 B2
(45) Date of Patent: May 31, 2016

(54) DEVICE AND A SYSTEM AND A METHOD OF EXAMINING A TUBULAR CHANNEL

(75) Inventors: Wilhelmus Hubertus Paulus Maria Heijnen, Stromberg (DE); Robert Bouke Peters, Doha (QA)

(73) Assignee: MAERSK OIL QATAR A/S, Copenhagen K (DK)

( * ) Notice: Subject to any disclaimer, the term of this patent is extended or adjusted under 35 U.S.C. 154(b) by 1098 days.

(21) Appl. No.: 13/496,456

(22) PCT Filed: Sep. 14, 2010

(86) PCT No.: PCT/EP2010/063436

§ 371 (c)(1),
(2), (4) Date: Jun. 22, 2012

(87) PCT Pub. No.: WO2011/032928

PCT Pub. Date: Mar. 24, 2011

(65) Prior Publication Data

US 2012/0277997 A1 Nov. 1, 2012

Related U.S. Application Data

(60) Provisional application No. 61/242,959, filed on Sep. 16, 2009.

(30) Foreign Application Priority Data

Sep. 16, 2009 (DK) ..... 2009 01032

(51) Int. Cl.
*E21B 23/00* (2006.01)
*E21B 23/08* (2006.01)
*E21B 23/14* (2006.01)

(52) U.S. Cl.
CPC ..... *E21B 23/08* (2013.01); *E21B 23/14* (2013.01); *E21B 2023/008* (2013.01)

(58) Field of Classification Search
CPC ..... E21B 2023/008; E21B 23/08
See application file for complete search history.

(56) References Cited

U.S. PATENT DOCUMENTS 2,122,697 A 10/1935 Potter
3,937,278 A 2/1976 Sheshtawy (Continued)

FOREIGN PATENT DOCUMENTS

DE 23 58 371 A1 5/1975
WO WO 98/12418 3/1998

OTHER PUBLICATIONS

PCT International-Type Search Report for DK 200901032, dated Apr. 7, 2010, 4 pages.

(Continued)

*Primary Examiner* — Lisa Caputo
*Assistant Examiner* — Punam Roy
(74) *Attorney, Agent, or Firm* — Brinks Gilson & Lione

(57) ABSTRACT

The invention relates to a device for examining a tubular channel, the device comprising a three-way valve, buoyancy means, pressure means, a vent line, at least one sensor and computation means; wherein the three-way valve controls the fluid flow between the pressure means and the buoyancy means and between the buoyancy means and the vent line; the computation means is communicatively coupled to the at least one sensor and adapted to generate a control signal based on data received from the at least one sensor; and wherein the pressure means is fluidly coupled to the buoyancy means via the three-way valve such that a fluid may flow from the pressure means to the buoyancy means or from the buoyancy means to the surroundings of the device via the vent line; and wherein the computation means is communicatively coupled to the three-way valve and controls said three-way valve via the control signal. Thereby, the invention is able to examine e.g. oil wells containing obstructions such as wash-outs and/or side tracks and/or non-linear parts in open hole completions of the well.

23 Claims, 9 Drawing Sheets

(56) References Cited

U.S. PATENT DOCUMENTS

| | | | | |
|---|---|---|---|---|
| 4,216,886 | A * | 8/1980 | Puschalovsky | G01G 17/04 164/155.7 |
| 5,955,666 | A | 9/1999 | Mullins | |
| 6,241,028 | B1 | 6/2001 | Bijleveld et al. | |
| 6,845,819 | B2 * | 1/2005 | Barrett et al. | 166/250.01 |
| 7,934,704 | B2 * | 5/2011 | Tharp | B01F 3/0412 210/242.2 |
| 2002/0096322 | A1 | 7/2002 | Barrett et al. | |
| 2008/0019214 | A1 * | 1/2008 | Pramik | G01V 1/3861 367/16 |
| 2012/0292049 | A1 * | 11/2012 | Heijnen et al. | 166/381 |
| 2014/0054031 | A1 * | 2/2014 | Heijnen et al. | 166/250.17 |

OTHER PUBLICATIONS

Search Report for Application No. PA 2009 01032, dated Apr. 13, 2010, 1 page.

* cited by examiner

DEVICE AND A SYSTEM AND A METHOD OF EXAMINING A TUBULAR CHANNEL

RELATED APPLICATIONS

This application claims the benefit under 35 U.S.C. §371 of International Patent Application No. PCT/EP2010/063436, having an international filing date of Sep. 14, 2010, which claims priority to Danish Patent Application No. PA 2009 01032, filed Sep. 16, 2009, and U.S. Provisional Application No. 61/242,959, filed Sep. 16, 2009, the contents of all of which are incorporated herein by reference in their entirety.

TECHNICAL FIELD

The invention relates to a device for examining a tubular channel. The invention further relates to a corresponding method and system.

BACKGROUND

In order to find and produce hydrocarbons e.g. petroleum oil or gas hydrocarbons such as paraffins, naphthenes, aromatics and asphaltics or gases such as methane, a well may be drilled in rock (or other) formations in the Earth.

After the well bore has been drilled in the earth formation, a well tubular may be introduced into the well. The well tubular covering the producing or injecting part of the earth formation is called the production liner. Tubulars used to ensure pressure and fluid integrity of the total well are called casing. Tubulars which bring the fluid in or from the earth formation are called tubing. The outside diameter of the liner is smaller than the inside diameter of the well bore covering the producing or injecting section of the well, providing thereby an annular space, or annulus, between the liner and the well bore, which consists of the earth formation. This annular space can be filled with cement preventing axial flow along the casing. However if fluids need to enter or leave the well, small holes will be made penetrating the wall of the casing and the cement in the annulus therewith allowing fluid and pressure communication between the earth formation and the well. The holes are called perforations. This design is known in the oil and natural gas industry as a cased hole completion.

An alternative way to allow fluid access from and to the earth formation can be made, a so called open hole completion. This means that the well does not have an annulus filled with cement but still has a liner installed in the earth formation. The latter design is used to prevent the collapse of the bore hole. Yet another design is when the earth formation is deemed not to collapse with time, then the well does not have a casing covering the earth formation where fluids are produced from. When used in horizontal wells, an uncased reservoir section may be installed in the last drilled part of the well. The well designs discussed here can be applied to vertical, horizontal and/or deviated well trajectories.

To produce hydrocarbons from an oil or natural gas well, a method of water-flooding may be utilized. In water-flooding, wells may be drilled in a pattern which alternates between injector and producer wells. Water is injected into the injector wells, whereby oil in the production zone is displaced into the adjacent producer wells.

The water pressure required in order to push the oil into the producer wells must overcome the fluid friction losses in the earth formation between injector and producer and must overcome the reservoir pressure minus the hydrostatic head of the injection fluid. The water pressure, possibly combined with a low water temperature e.g. in the order of 5 degrees C., can induce fractures in the rock of the reservoir formation. If a fracture extends from an injector well to a producer well, it may form a channel through which water may be conveyed directly from the injector well to the producer well therewith not pushing the oil or gas in front of the water to the oil or gas production well.

Water may also be conveyed through naturally occurring fractures in the earth formation and thereby not push the oil to the producing well.

Knowledge of the position of such water bearing fractures may in the prior art be determined by conveying a suite of petrophysical tools in the well to determine where water is located. This can be done in an open hole completion or after cementing a liner in the open hole.

However, cementing a liner in an open hole completion may be associated with a number of technical problems, such as for example: 1) the liner may run into an existing side track or a leg of a fishbone well; 2) cementation of the liner cannot be carried out due to losses; 3) the cementation causes fractures in the reservoir creating a connection to another well.

Conveying petrophysical tools into wells, especially horizontal wells is limited to the depth that can be reached with any means of conveyance suitable for particular well dimensions.

Thus, it may be advantageous to be able to identify such water bearing fractures without cementing a liner into the open hole completion and without having to convey petrophysical logging tools into horizontal wells by conventional means.

U.S. Pat. No. 6,241,028 disclose a method and system for measuring data in a fluid transportation conduit, such as a well for the production of oil and/or gas. The system employs one or more miniature sensing devices which comprise sensing equipment that is contained in a preferably spherical nut-shell. However, horizontal wells need not be straight. Further, wells may contain obstructions such as wash-outs and/or well side tracks, e.g. in fishbone wells, which may prevent the above system from examining the entire well.

Thus, it may be advantageous to be able to examine wells comprising obstructions such as wash-outs and/or side tracks and/or to be able to examine non-straight horizontal wells.

Therefore, an object of the invention is to enable examination of wells containing obstructions such as wash-outs and/or side tracks and/or non-linear well part in open hole completion parts of the well.

SUMMARY

The object of the invention is achieved by a device for examining a tubular channel, the device comprising a three-way valve, buoyancy means, pressure means, a vent line, at least one sensor and computation means; wherein the three-way valve controls the fluid flow between the pressure means and the buoyancy means and between the buoyancy means and the vent line; the computation means is communicatively coupled to the at least one sensor and adapted to generate a control signal based on data received from the at least one sensor; and wherein the pressure means is fluidly coupled to the buoyancy means via the three-way valve such that a fluid may flow from the pressure means to the buoyancy means or from the buoyancy means to the surroundings of the device via the vent line; and wherein the computation means is communicatively coupled to the three-way valve and controls said three-way valve via the control signal.

Thereby, the device may be prevented from getting stuck in a wash-out, e.g. in the bottom of a tubular channel or in the top of a tubular channel because via the at least one sensor, the device is able to detect the wash-out and calculate a control signal indicating how much fluid the three way valve is to let into the buoyancy means. Thereby, the device is able to dive below or above the wash-out Further, the device may be prevented from navigating into a wrong tubular channel e.g. an unintended side track or leg of a fishbone well, by first detecting the tracks in front of the device and subsequently changing the buoyancy of the device accordingly.

Further embodiments and advantages of the invention are disclosed in the below detailed description and the claims.

BRIEF DESCRIPTION OF THE DRAWINGS

The invention will now be described more fully below with reference to the drawings, in which.

DETAILED DESCRIPTION

Figure 1:
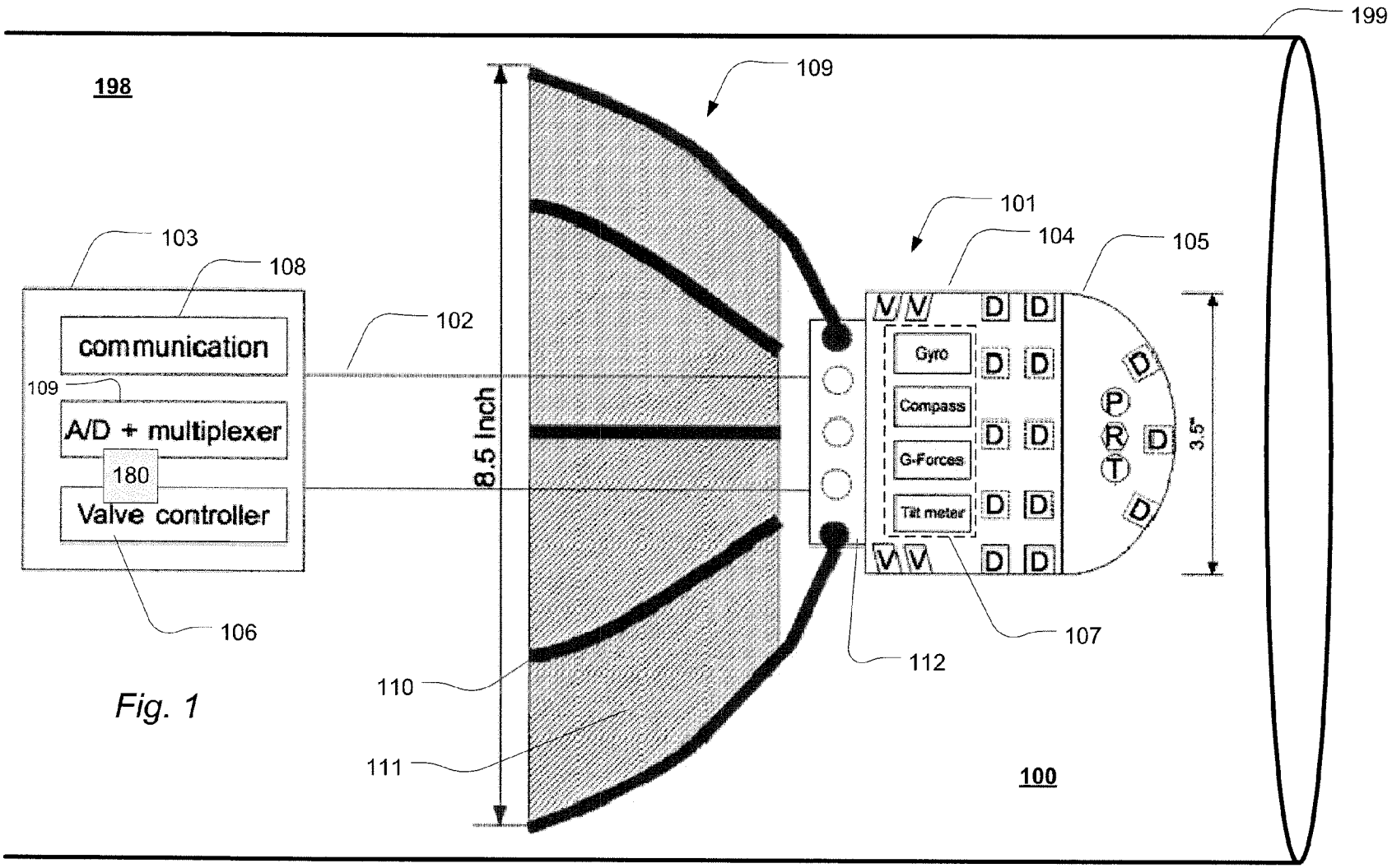
FIG. 1 shows a sectional view of an embodiment of a device 100 for examining a tubular channel comprising a first, a second and a third part.

FIG. 1 shows a sectional view of an embodiment of a device 100 for examining a tubular channel 199 comprising a first 101, a second 102 and a third 103 part. Below and above, a tubular channel may be exemplified by a borehole, a pipe, a fluid-filled conduit, and an oil-pipe.

The tubular channel 199 may contain a fluid. In the above and below, the fluid in the tubular channel may be exemplified by water, hydrocarbons, e.g. petroleum oil or gaseous hydrocarbons such as paraffins, naphthenes, aromatics, asphaltics and/or methane or gases with longer hydrocarbon chains such as butane or propane or any mixture thereof.

Figure 1B:
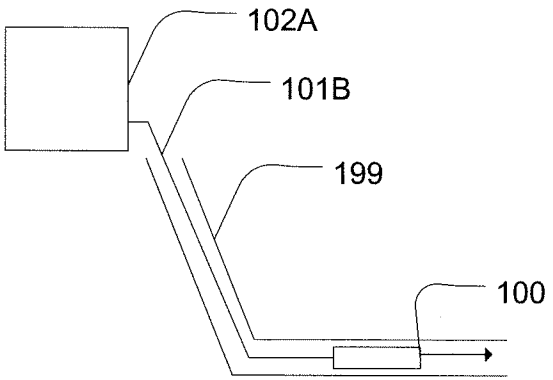
FIG. 1B shows a device connected to a external communication unit.
Figure 1A:
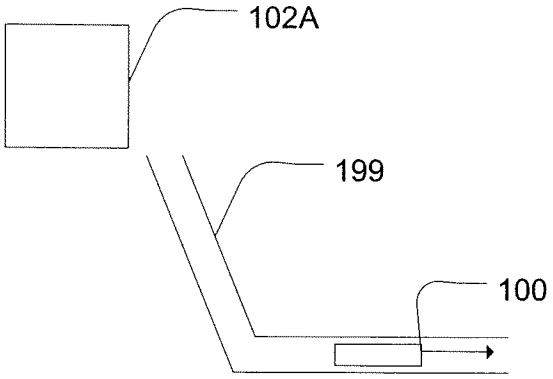
FIG. 1A shows a device pumped down into the tubular channel.

In an embodiment as illustrated in FIG. 1A, the device 100 may for example be pumped down into the tubular channel 199 without any physical connection/link to the surface/entrance of the tubular channel 199. In such an embodiment, the device 100 may be powered by batteries or obtain it's power from the earth formation and/or the fluids in the well. Also hydrogen cells or combustion processes can be used to power the device. In the case of batteries, the batteries may be powered/charged by temperature differences of the surrounding via thermocouples and/or by a spinner driven by the fluid motion around the device 100 driving a dynamo being electrically coupled to the batteries. An external communication unit 102A, such as a computer communicatively coupled to an acoustic modem, situated in proximity to the entrance of the tubular channel 199 may communicate with the device 100 e.g. via the acoustic modem.

In an alternative embodiment as illustrated in FIG. 1B, the device 100 may be connected via e.g. a wire 101B to an external communication unit 102A, such as a computer, situated in proximity to the entrance of the tubular channel 199. The external communication unit 102A may provide power to the device 100 via the wire which power could propel the device 100 down into tubular channel 199. Additionally or alternatively, the external communication unit 102A may communicate with the device 100 via the wire 101B.

The device 100 may comprise a first part 101, a second part 102 and a third part 103.

The three parts 101, 102 and 103 may e.g. be cast or moulded in plastic or aluminium or any other material or combinations thereof suitable of sustaining high pressure, which in high pressure wells can go up to 2000 bar, and temperatures ranging from e.g. 40 degrees C. at shallow depth to 200 degrees C. and beyond in the case of a high temperature well.

The first part 101 may, for example, contain a cylindrical part 104 and a semi-spherical cap part 105. The first part 101 may further contain a number of sensors.

For example, the first part may contain a number of ultrasonic sensors V, e.g. 4 ultrasonic sensors, for determining the relative fluid velocity around the first part 101. An ultrasonic sensor may be represented by a transducer. The ultrasonic sensors V may be contained within the first part 101, e.g. within the cylindrical part 104. The ultrasonic sensors V may provide data representing a fluid velocity.

Additionally, the first part 101 may, for example, include a number of ultrasonic distance sensors D, e.g. 13 ultrasonic distance sensors. The number of ultrasonic distance sensors may provide data representing a distance to e.g. the surrounding tubular channel 199. The ultrasonic distance sensors may be contained within the first part 101. For example, 10 ultrasonic distance sensors may be contained in the cylindrical part 104 of the first part 101, e.g. in a circumference of the cylindrical part 104 and thereby providing data representing a distance between the cylindrical part 104 and the surrounding tubular channel 199, and 3 ultrasonic distance sensors may be contained in the semi-spherical cap part 105, e.g. in the front of the semi-spherical cap part 105 providing data representing a distance between the semi-spherical cap-part and e.g. potential obstacles such as cave-ins/wash-outs in front of the device 100.

The ultrasonic sensors and ultrasonic distance sensors of the first part may be probing the fluid surrounding the device 100 and the tubular channel 199 through e.g. glass windows such that the sensors are protected against the fluid flowing in the tubular channel 199.

The first part may additionally comprise a pressure sensor P. The pressure sensor P may be contained in the semi-spherical cap part 105. The pressure sensor P may provide data representing a pressure of a fluid surrounding the device 100.

Further, the first part may contain an ohmmeter R for measuring the resistivity of the fluid surrounding the device 100. The ohmmeter may be contained in the semi-spherical cap part 105. The ohmmeter may provide data representing resistivity of the fluid surrounding the device 100.

Further, the first part may contain a temperature sensor T for measuring the temperature of the fluid surrounding the device 100. The temperature sensor T may be contained in the semi-spherical cap part 105. The temperature sensor T may provide data representing a temperature of the fluid surrounding the device 100.

The first part may additionally comprise a position-determining unit 107 providing data representing the position of the first part 101, and thus enabling position tagging of the data from the abovementioned sensors. The position tagging may, for example, be performed with respect to e.g. the entrance of the tubular channel 199.

In an embodiment, the position-determining unit 107 may comprise gyroscopes Gyro and a compass Compass and accelerometers G-forces and a tiltmeter (inclinometer) Tilt meter.

The device 100 may further comprise a programmable logic controller (PLC) 180 e.g. contained in the first 101 or in the third part 103. One or more of the above sensors, i.e. the ultrasonic sensors V, the ultrasonic distance sensors D, the pressure sensor P, the ohmmeter R, the temperature sensor T, and the position-determining unit 107, may be connected to the PLC e.g. via a wire and an analogue-to-digital (A/D) converter and a multiplexer 109. For example, the PLC may be connected via respective wires and the analogue-to-digital (A/D) converter and a multiplexer 109 to the ultrasonic sensors V, the ultrasonic distance sensors D, and the position-determining unit 107. Via a number of data input from the sensors, the PLC is able to determine the surroundings and position of the device 100 and to calculate a control signal representing how the device 100 is to be steered. Thus, the PLC 180 may determine how to navigate through the tubular channel 199 via one or more of the steering mechanisms disclosed below i.e. in FIGS. 2, 3, 4 and 5 and associated text. For example, the PLC 180 may be communicatively coupled, e.g. via electric wires, to each of the steering mechanisms, and the PLC 180 may control the steering mechanisms via the control signal.

Figures 2, 3:
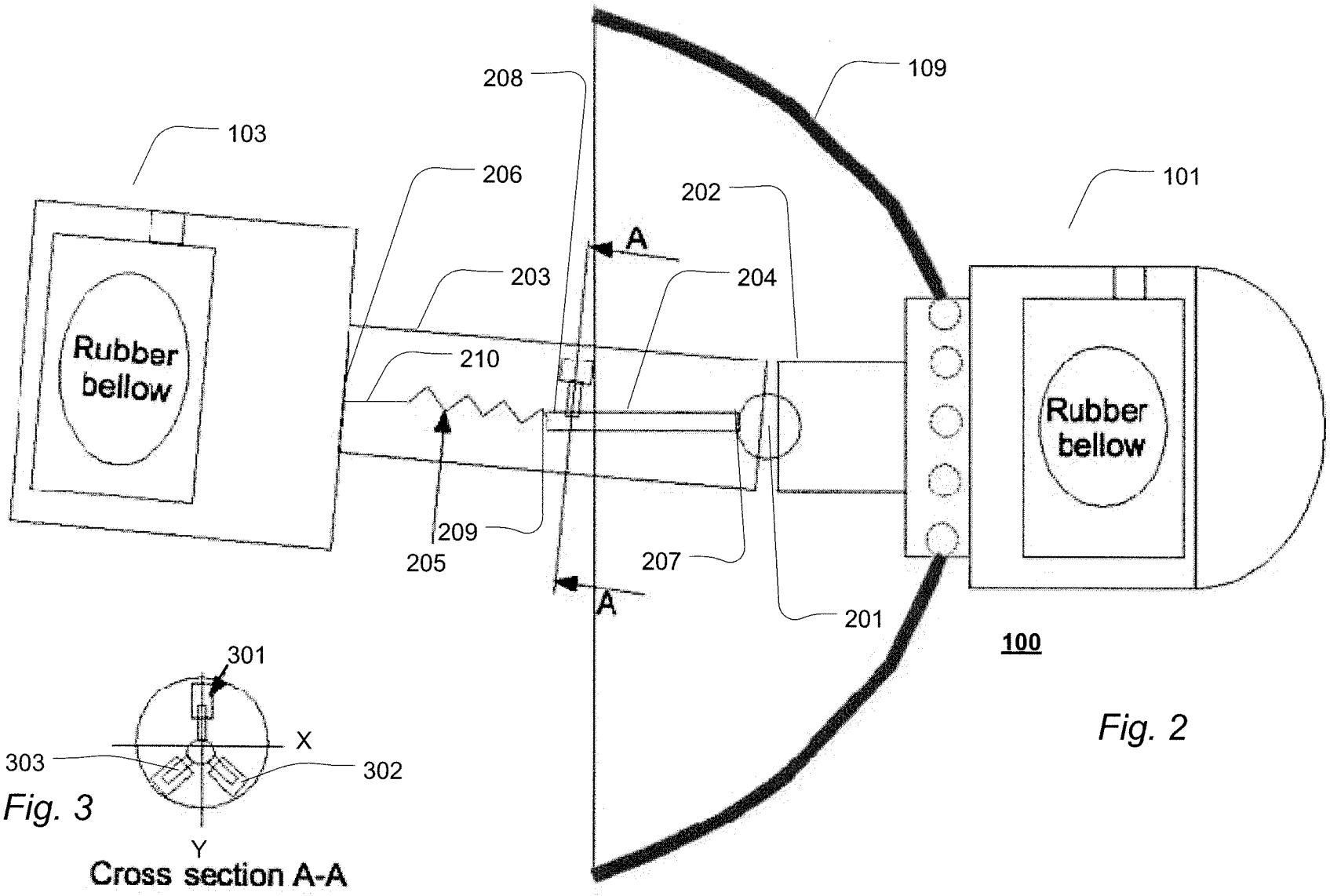
FIG. 2 shows the fishing neck of the device.
FIG. 3 shows a cross-sectional view of the fishing neck of the device.

The second part 102 may comprise a two-piece bar ("fishing neck") 202 and 203 connected via a ball joint 201 as seen in FIG. 2. The two-piece bar 202, 203 may have a cylindrical cross-section and may be hollow. Further, the two-piece bar 202, 203 may connect the first part 101 to the third part 103 via the ball joint 201. As illustrated in the figure, a first part 202 of the two-piece bar 202, 203 may be connected to the first part 101 of the device 100 and a second part 203 of the two-piece bar 202, 203 may be connected to the third part 103 of the device 100.

One of the two-piece bar parts, e.g. the second part 203, may contain a bar 204 physically connected at one end 207 to the ball joint 201 e.g. via glue, weld joint or the like. The other end 208 of the bar may be connected to a first end 209 of a spring 205. The other end 210 of the spring 205 may be physically connected to a side 206 of the second part 102 of the device 100 e.g. the side also connected to the second part 203 of the two-piece bar. The force exerted by the spring on the side 206 and the other end 208 of the bar 204 is of such a magnitude as to keep the device 100 i.e. the first part 202 and the second part 203 of the two-piece bar, in a straight line (e.g. 180 degrees+/−1 degree between the first part and the second part of the two-piece bar) via the ball-joint 201 when none of the cylinders disclosed below are activated.

A cross-sectional view along the line A-A in FIG. 2 is shown in FIG. 3. FIG. 3 illustrates three cylinders 301. The cylinders 301 may e.g. be hydraulic or mechanical or a combination of hydraulic and mechanical cylinders (for example, a first cylinder may be mechanical and a second and a third cylinder may be hydraulic).

Each cylinder may comprise a cylinder barrel 302 and a piston 303. The cylinder barrels 302 may be connected to the inner wall of the second part 203 of the two-piece bar. The connection may be performed e.g. by a weld joint or a screw or glue or the like. The pistons 303 may be connected to the other end of the bar 208 e.g. by weld joints, glue, screws or the like.

The barrels 302 of the cylinders 301 may e.g. be placed at a 120 degree separation along the circumference of the inner wall of the second part 203 of the two-piece bar.

In order to steer the device 100, one or more of the cylinders may be activated in order to displace the bar 204 from the equilibrium position determined by the spring 205. The cylinders 301 may be able to displace the bar 204 in any position. In FIG. 3, for example, the top cylinder 301 has been activated and displaced the bar 204 from its spring determined equilibrium position determined by the intersection of the two lines X and Y. Thereby, the straight line between the first part 202 and the second part 203 of the two-piece bar is changed e.g. to 135 degrees+/−1 degree whereby the device 100 longitudinal axis is bend around the ball joint 201.

If the three cylinders are hydraulic, then the spring 205 may be replaced by springs in the cylinders such that when the cylinders are un-activated, the spring forces of the springs in the cylinders are of such a magnitude as to keep the device 100 i.e. the first part 202 and the second part 203 of the two-piece bar, in a straight line. The springs are located in the cylinders pushing on the pistons e.g. between the pistons 303 and the bar 204.

In an embodiment, the springs between the pistons 303 and the bar 204 may be push springs.

The bar 204 and the ball joint 201 may be hollow such as to, for example, allow passage of an electric wire from the first part 101 to the third part 103 via the two-piece bar and the ball-joint 201 and the bar 204. Additionally, the bar 204 and the ball joint 201 may allow passage of a tube e.g. a high pressure tube.

Thus, the device 100 may be steered by controlling the cylinders 301 and thereby the fishing-neck of the device 100.

In an embodiment, data from one or more of the sensors in the first part 101 may be transmitted to the third part 103 via an electric wire from the first part 101 to the third part 103 via the ball joint 201 and the bar 204.

Figure 4:
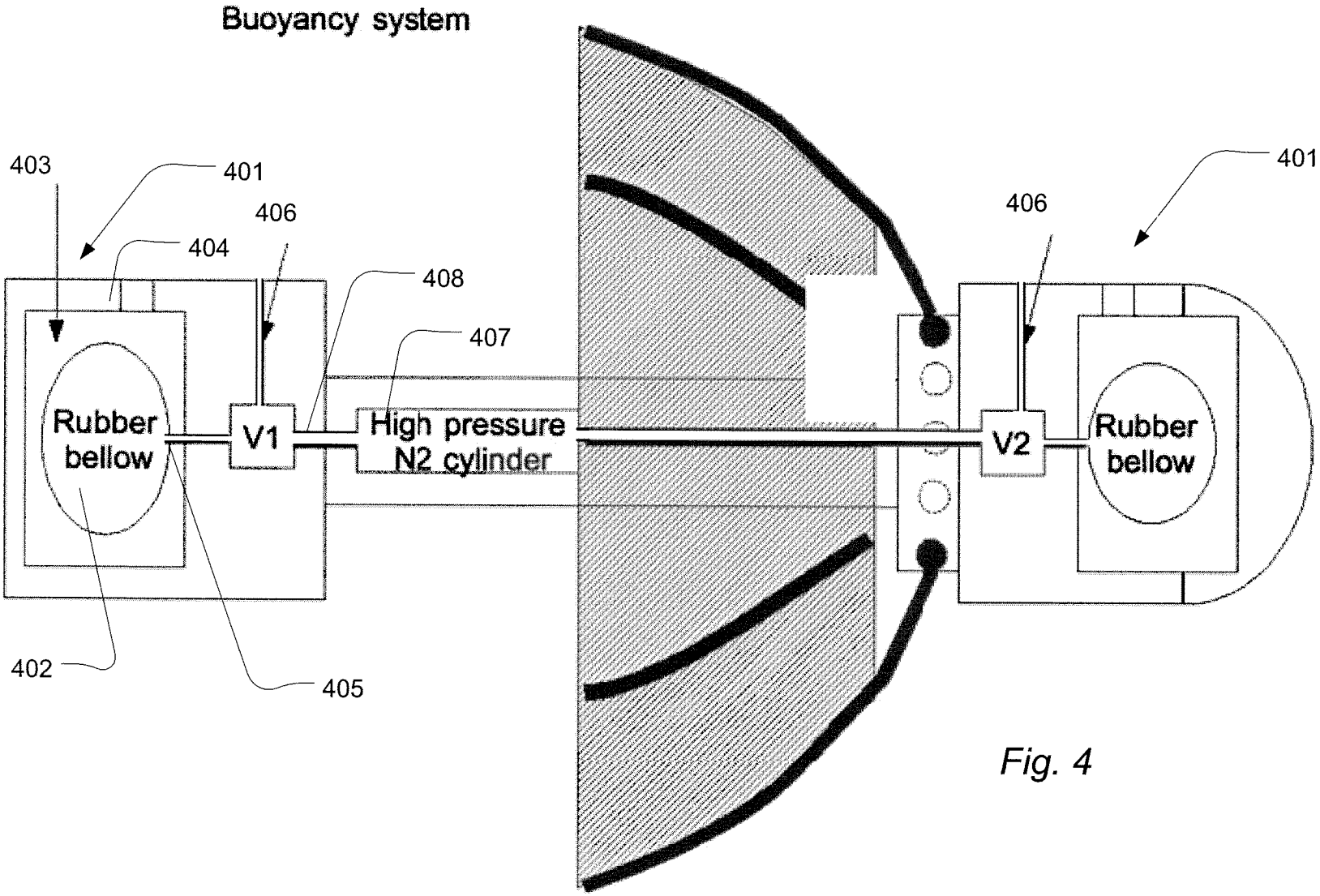
FIG. 4 shows an embodiment of a device 100 for examining a tubular channel comprising buoyancy means.

In an embodiment, the high pressure cylinder 407 of FIG. 4 may be in fluid communication with the three hydraulic cylinders of FIG. 2 e.g. via high pressure tubes and respective valves and chokes (to provide more accuracy to the fluid flow by limiting the volume per unit time). Thereby, the three hydraulic cylinders 301 may be powered by the high pressure cylinder 407. The amount of second fluid transferred from the high pressure cylinder 407 to the cylinders 301 may be controlled by the PLC 180 via the control signal by controlling the valves.

In the above and below, the second fluid contained in the high-pressure cylinder 407 may be chosen from the group of fluids which are known for their expansion when the pressure drops. The most effective fluids are therefore gaseous. For example Nitrogen or Helium or hydrocarbon gas or CO2 could be used as the second fluid with which the cylinder 407 is filled.

In an alternative embodiment, the three cylinders may be mechanical cylinders being controlled and driven by motors which in turn are powered by e.g. batteries or any other alternative energy source.

Alternatively, in the embodiment where the device is connected via a wire to an external communication unit 102A positioned in proximity of the entrance providing power to the device 100 via the wire, the three cylinders may be powered via the wire.

The third part 103 of the device 100 may comprise communication means 108 such as an acoustic modem enabling communication between the device 100 and the surface, e.g. the external communication unit 102A positioned in the proximity to the tubular channel 199 entrance. For example, the device 100 may transmit data from one or more of the sensors to the external communication unit 102A via the communication means 108.

In an embodiment, repeaters may be utilized in connection with the acoustic modem. A repeater may pick up a signal from the acoustic modem of the device 100 (or from another repeater) and amplify the received signal to its original strength. Thereby, the distance over which the device may communicate with the external communication unit 102A may be increased. The repeaters may, for example, be pumped down the tubular channel 199 e.g. when/if the signal received from the communication 108 means of the device 100 drops below a threshold value e.g. 10 dBm.

Alternatively or additionally, the communication means 108 may comprise a number of radio-frequency identification (RFID) tags e.g. 100 RFID tags. The RFID tags may be released from the device 100 at a regular time interval e.g. one RFID tag every 2 minutes, and before release, a RFID tag would be imprinted with the data recorded by the sensors at the position of its release. When the device 100 has travelled a required distance e.g. to the end of the tubular channel 199, the RFID tags may be brought up and recovered at the entrance of the tubular channel 199, e.g. at the surface of the well, during fluid production. At the surface of the well, the RFID tags may be read out. Other microchips which can contain data like the memory components in a USB stick can also be used. The requirement for obtaining the data is that the well has to be produced such that the RFID or other memory devices, such as memory chips, will be brought to surface.

In an embodiment, the RFID tags may be comprised in the device 100 e.g. in the third part 103 and the RFID tags may be released from the device 100 e.g. via a tube in the rear end of the third part 103 i.e. the end facing away from the second part 102. Via a controlled detonation performed by detonation means in fluid communication with the tube, a RFID tag may be released at certain intervals controlled by the PLC 180. For example, the PLC 180 may control the detonation means In an embodiment, the communication means 108 may further be adapted to receive acoustic signals from the entrance of the tubular channel thereby enabling a two-way communication between the external communication means 102A comprising an acoustic modem and being positioned in proximity to the tubular channel 199 entrance and the device 100. Thereby, the device 100 may for example receive control data from the external communication unit 102A via the communication means 108.

The third part may additionally comprise a valve controller 106 for controlling a number of valves as disclosed below.

Further, the third part 103 may comprise a analogue-to-digital (A/D) converter and a multiplexer 109. The A/D converter and multiplexer may receive analogue data, e.g. from one or more sensors in the first part 101, via an electric wire and process the analogue data into digital data which, for example, may be transmitted to the surface of the well via the communication means 108 and/or via a wire 101B and/or the data may be processed by the PLC 180.

The device 100 may further comprise a flexible member 109. For example, the flexible member may comprise arms 110 made of titanium and a texture 111 made of aramid. The flexible member 109 may have a semi-spherical shape as indicated in FIG. 1 and the device 100 may, for example, be able to adjust the maximal outer diameter of the semi-spherical shape between for example 3.5 inch (88.9 mm) and 8.5 inch (215.9 mm). The outer diameter is limited by the fact that the flexible member cannot expand further than the mentioned 8.5 inch because the flexible member has reached its maximum outer diameter. In a tubular channel with an inner diameter of below 8.5 inch, the outer diameter of the flexible member may be determined by the inner diameter of the tubular channel.

Thereby, the device is able to run through tubing and thus, the top completion of a well does not have to be removed (pulled of) in order to run the device into the well.

The flexible member 109 may e.g. be attached to the first part 101. For example, the first part 101 may comprise a cylindrical attachment part 112 to which the flexible member 109 may be attached e.g. via weld joints or a ball bearing. The projection of the flexible member on the second part 102 may be varied and it may depend on the outer diameter of the semi-spherical shape. If for example the flexible member 109 is fully expanded (maximal outer diameter) then the projection of the flexible member 109 onto the second part 102 (i.e. the longitudinal axis of the device 100) is minimal. If for example the flexible member 109 is fully collapsed (minimal outer diameter) then the projection of the flexible member 109 onto the second part 102 is maximal. Alternatively or additionally, the projection of the flexible member 109 onto the second part 102 may be varied by altering the angle of the flexible member. Changing the angle of the flexible member will cause an unbalanced push force on the flexible member versus the axis of the device this will move the device away from the axis.

The flexible member 109 may, for example, be utilized in propelling the device 100 down the tubular channel 199. By applying a pressure on the entrance 198 side of the tubular channel 199 may expand the flexible member 109 to its maximal size, whereby the device 100 may be propelled down the tubular channel 199. If, for example, the device 100 encounters a cave-in (or a wash-out) in its path, the device 100 may change the maximal outer diameter of the flexible member such as to enable passage of the device 100 past the cave-in by adapting the outer diameter of the device 100 to the diameter of the cave-in.

FIG. 4 shows an embodiment of a device 100 for examining a tubular channel comprising buoyancy means 401. The device 100 of FIG. 4 may comprise the technical features described under FIGS. 1 and/or 2 and/or 3.

Further, the device of FIG. 4 may comprise buoyancy means 401 (e.g. float tanks or hydrophores) in the first part 101 and in the third part 103. Each of the buoyancy means 401 may comprise a rubber bellow 402 contained in a titanium cylinder 403. The titanium cylinders 403 prevent the rubber bellows 402 from bursting. The titanium cylinders 403 further comprise an in-/outlet 404 enabling fluid from the tubular channel 199 to enter or exit. The in-/outlet 404 of the titanium cylinders may be covered with a permeable metal membrane.

The first part 101 and the third part 103 may each further comprise a three-way valve V1, V2. The three-way valve V1, V2 may be fluidly coupled to the respective rubber bellow 402 e.g. via respective tubes 405. Further, the three-way valves V1, V2 may be fluidly coupled to the fluid in the tubular channel via respective vent lines 406. Additionally, each of the three-way valves V1, V2 may be fluidly coupled to a high pressure cylinder 407, e.g. situated in the second part 102 of the device 100, via respective tubes 408. The high pressure cylinder 407 may contain a second fluid.

The three-way valves V1, V2 may be controlled by the valve controller 106 which may be communicatively coupled to the three-way valves V1, V2 e.g. via an electric wire. The valve controller 106 may, for example, receive control signals from the PLC ordering the valve controller 106 to increase and/or decrease buoyancy of the buoyancy means 401 according to the calculation results obtained by the PLC. The PLC may be communicatively coupled to the valve controller 106 e.g. via an electric wire.

Using the high pressure cylinder 407 and the three-way valves 406 and the buoyancy means 401, the device 100 is able to control its buoyancy.

For example, in the event that the rubber bellows 402 are filled with the second fluid e.g. N2 and the buoyancy is to be decreased i.e. the device 100 has to dive, then the three-way valve V1, V2 is opened between the rubber bellow 402 and the N2 vent line 406, whereby fluid from the tubular channel 199 may enter the titanium cylinder 403 via the permeable metal membrane 404 and simultaneously, the second fluid may flow out of the rubber bellow 402 through the N2 vent line 406 due to the elastic pressure exerted by the rubber bellow 402 on the second fluid. When the buoyancy of the device has been decreased sufficiently, e.g. determined by one or more of the sensors and the PLC 108, the three-way valve 406 is set in a closed position by receiving a control signal from the PLC 180.

Subsequently, if the buoyancy of the device 100 is to be increased i.e. the device 100 has to be raised, then the three-way valve V1, V2 is opened between the rubber bellow 402 and the high pressure cylinder 407, whereby the second fluid of the high pressure cylinder 407, e.g. N2, is pressed into the rubber bellow 402. Thereby, the rubber bellow 402 expands and thus displaces the fluid, e.g. fluid from the tubular channel, present in the titanium cylinder 403 via the permeable metal membrane 404. When the buoyancy of the device has been increased sufficiently, e.g. determined by one or more of the sensors and the PLC 108, the three-way valve 406 is set in a closed position by receiving a control signal from the PLC 180.

In an embodiment, a spinner/impeller may be attached to the permeable metal membrane 404 or placed inside the permeable metal membrane such that the spinner is spun when the fluid from the tubular channel 199 flows in or out via the permeable metal membrane 404. Thereby, the spinner is able to act as a dynamo and if the device 100 is powered by batteries, the spinner may be electrically coupled, e.g. via an electric wire, to the batteries of the device 100, and thereby the batteries may be recharged by the spinner.

In an embodiment, the three-way valves V1, V2 may be equipped with a flow restriction in order to limit the flow volume per unit time to thereby allow a certain accuracy of the three-way valves.

Thus, the device 100 may be steered by controlling its buoyancy using the high pressure cylinder 407, a three-way valve V1, V2, and the buoyancy means 401. The buoyancy of the device 100 may be controlled by the PLC 180 receiving data from the sensors and transmitting a control signal to the three-way valves V1, V2. Alternatively, the buoyancy of the device 100 may be controlled by the external communication unit 102A receiving data from the sensors and transmitting a control signal to the three-way valves V1, V2.

In an embodiment, the buoyancy means 401 may be used to e.g. steer the first part 101 up or down with respect to the ball joint 201 e.g. by increasing the buoyancy of the buoyancy means 401 in the first part 101, e.g. by pumping the second fluid from the high pressure cylinder 407, e.g. N2, into the rubber bellow 402 of the first part 101 thereby displacing fluid from the titanium cylinder 403 to the tubular channel, and/or decreasing the buoyancy of the buoyancy means 401 in the third part 103, e.g. by displacing the second fluid from the rubber bellow 402 with fluid from the tubular channel 199 in the titanium cylinder 403 of the third part 103, as disclosed above.

Figure 5:
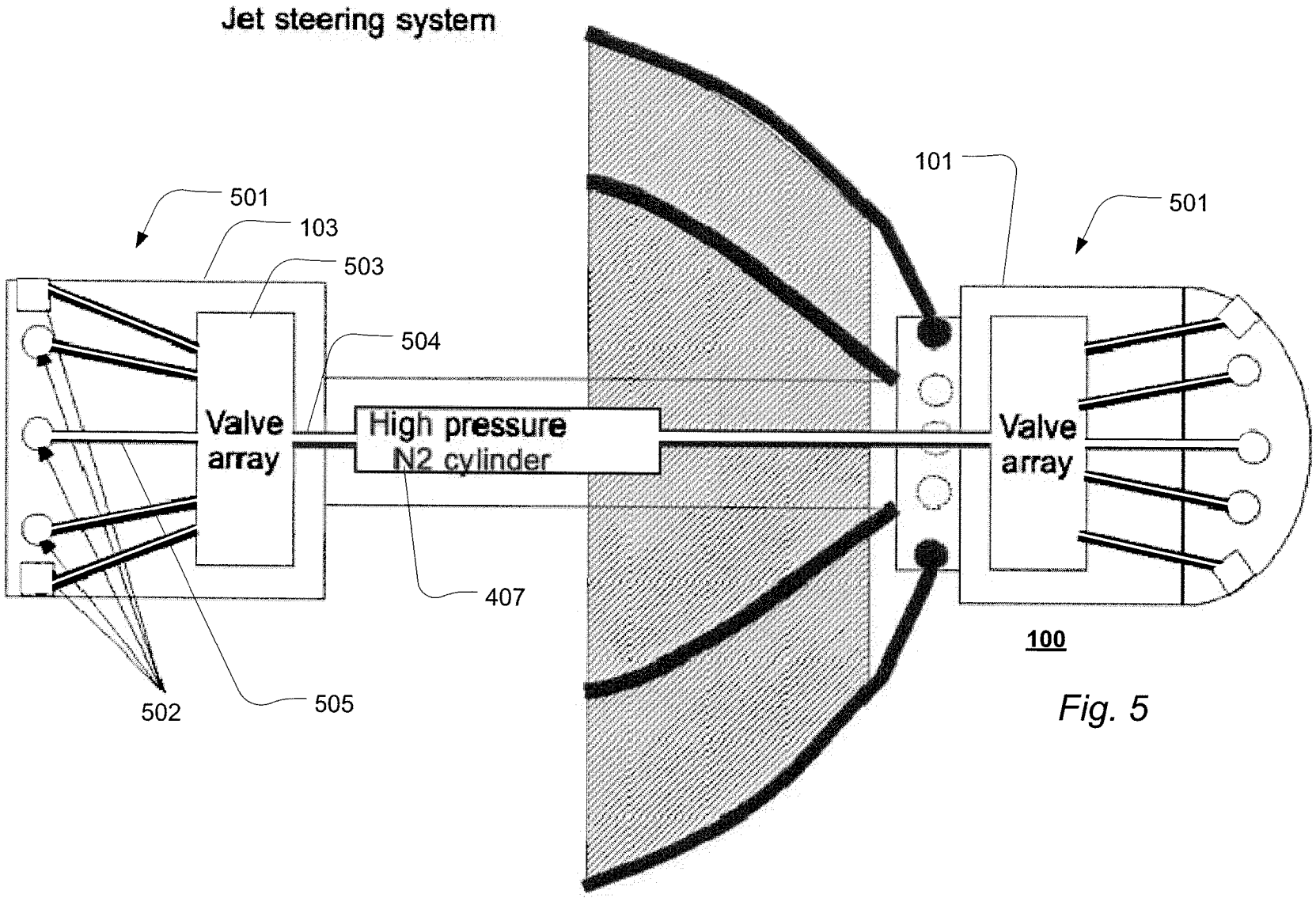
FIG. 5 shows an embodiment of a device 100 for examining a tubular channel comprising jet nozzle means.

FIG. 5 shows an embodiment of a device 100 for examining a tubular channel comprising jet nozzle means. The device 100 of FIG. 5 may comprise the technical features described under FIGS. 1 and/or 2 and/or 3 and/or 4.

Further, the device of FIG. 5 may comprise jet nozzle means 501 in the first part 101 and in the third part 103.

Each of the jet nozzle means 501 may comprise a number of nozzles 502, e.g. 5 nozzles, through which a jet of second fluid may be thrust. Additionally, the jet nozzle means 501 may comprise a valve array 503. The valve array 503 may be fluidly coupled to the high pressure cylinder 407 via e.g. respective high pressure tubes 504. Additionally, the valve array 503 may be fluidly coupled to each of the nozzles via respective high pressure tubes 505.

The nozzles 502 may be placed in the rear of the third part 103 and in the front of the first part 101 as seen in FIG. 5. Further, the nozzles may be in fluid communication with the fluid in the tubular channel 199 thereby enabling each nozzle to eject the second fluid, e.g. a high pressure fluid, from the high pressure cylinder 407 when enabled to do so via the valve array 502. The valve array 503 may be communicatively coupled to the PLC 180 e.g. via electric wires, such that the valve array 503 may be controlled by the PLC 180 e.g. based on sensor data treated by the PLC 180.

If, for example, the device 100 is to move straight forward, the valve array 501 may open a valve between the high pressure cylinder 407 and the centre nozzle 502 in the valve array 503 of the third part 103 thereby establishing a fluid coupling between the high pressure cylinder 407 and the centre nozzle 502. Thus, the second fluid may be trust from the high pressure cylinder 407 via the centre nozzle 502 straight backwards into the fluid of the tubular channel 199. Therefore, the device 100 will move in the opposite direction of the thrust second fluid due to conservation of momentum i.e. straight forwards.

If, for example, the device 100 is to move backwards and downwards, the valve array 501 may open a valve between the high pressure cylinder 407 and the top nozzle 502 in the first part 101 thereby establishing a fluid coupling between the high pressure cylinder 407 and the top nozzle 502. Thus, the second fluid may be trust from the high pressure cylinder 407 via the top nozzle 502 upwards and forwards into the fluid of the tubular channel 199. Therefore, the device 100 will move in the opposite direction of the thrust the second fluid due to conservation of momentum i.e. downwards and backwards.

Thus, the device 100 may be steered using the nozzles 502, the valve array 501 and the high pressure cylinder 407. The second fluid ejected from the nozzles of the device 100 may be controlled by the PLC 180 receiving data from the sensors and transmitting a control signal to the valve array 503 controlling the valve fluidly coupled to the nozzle(s) from which the second fluid is to be ejected. Alternatively, the second fluid ejected from the nozzles of the device 100 may be controlled by the external communication unit 102A receiving data from the sensors and transmitting a control signal to the valve array 503.

Figure 6:
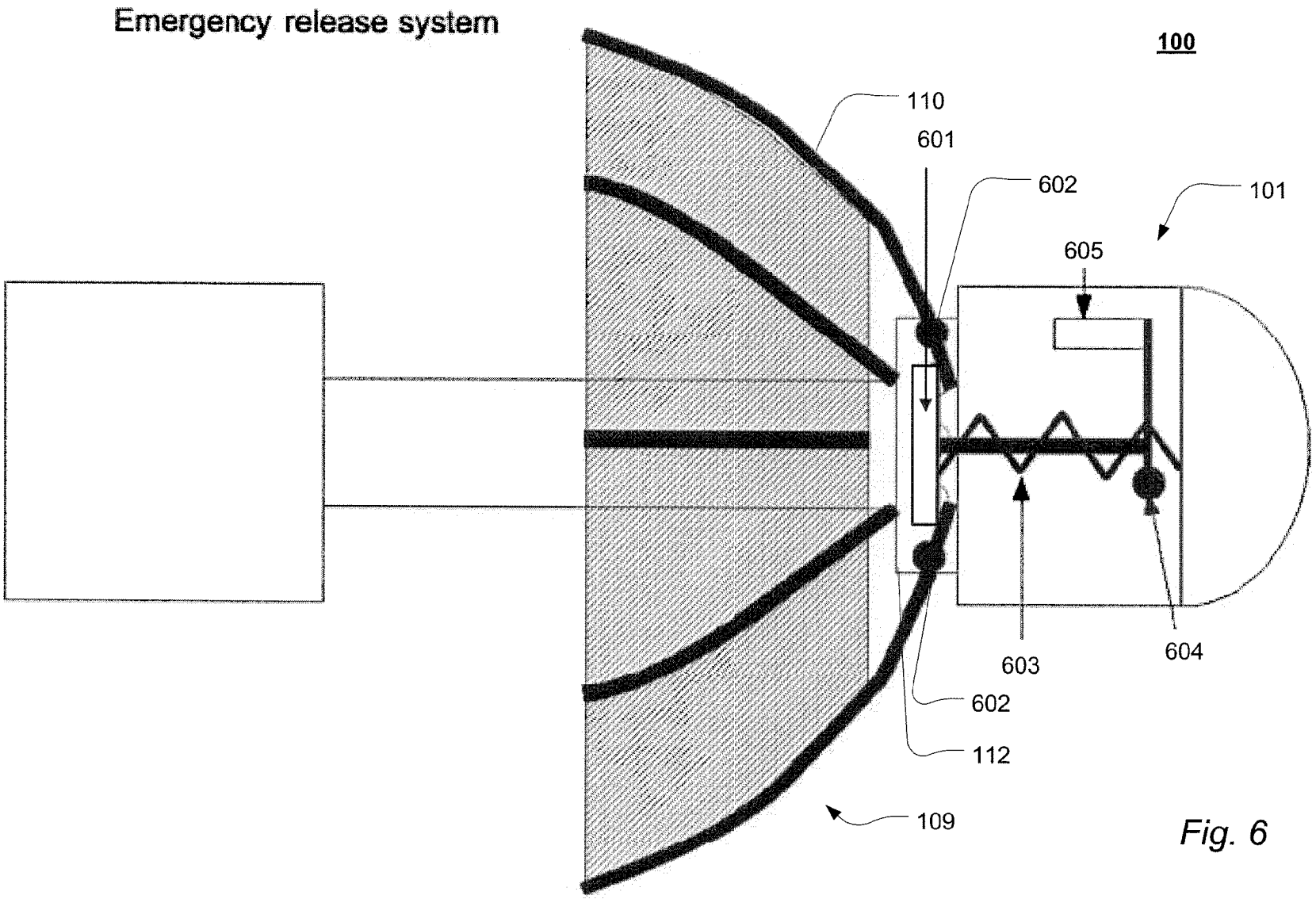
FIG. 6 shows an embodiment of a device 100 for examining a tubular channel comprising means for contracting the flexible member.

FIG. 6 shows an embodiment of a device 100 for examining a tubular channel comprising means for contracting the flexible member. The device 100 of FIG. 6 may comprise the technical features described under FIGS. 1 and/or 2 and/or 3 and/or 4 and/or 5.

Further, the device 100 of FIG. 6 may, in the first part 101, comprise a disc 601, e.g. positioned in the cylindrical attachment part 112, to which disc 601 the arms 110 of the flexible member 109 may be in physical contact. Further, the arms 110 may be attached to the cylindrical attachment part 112 via ball bearing 602 or the like enabling the flexible arms 110 to rotate around the ball bearing 602. Thereby, by translating the disc 601 to the right of FIG. 6, the arms 110 may be collapsed and by translating the disc 601 to the left of FIG. 6, the arms may expand e.g. due to fluid pressure in the tubular channel 199. Further, the first part 101 may comprise a spring 603, a second rotating bar 604 and an electro-magnet 605 further described under FIG. 7.

Figure 7:
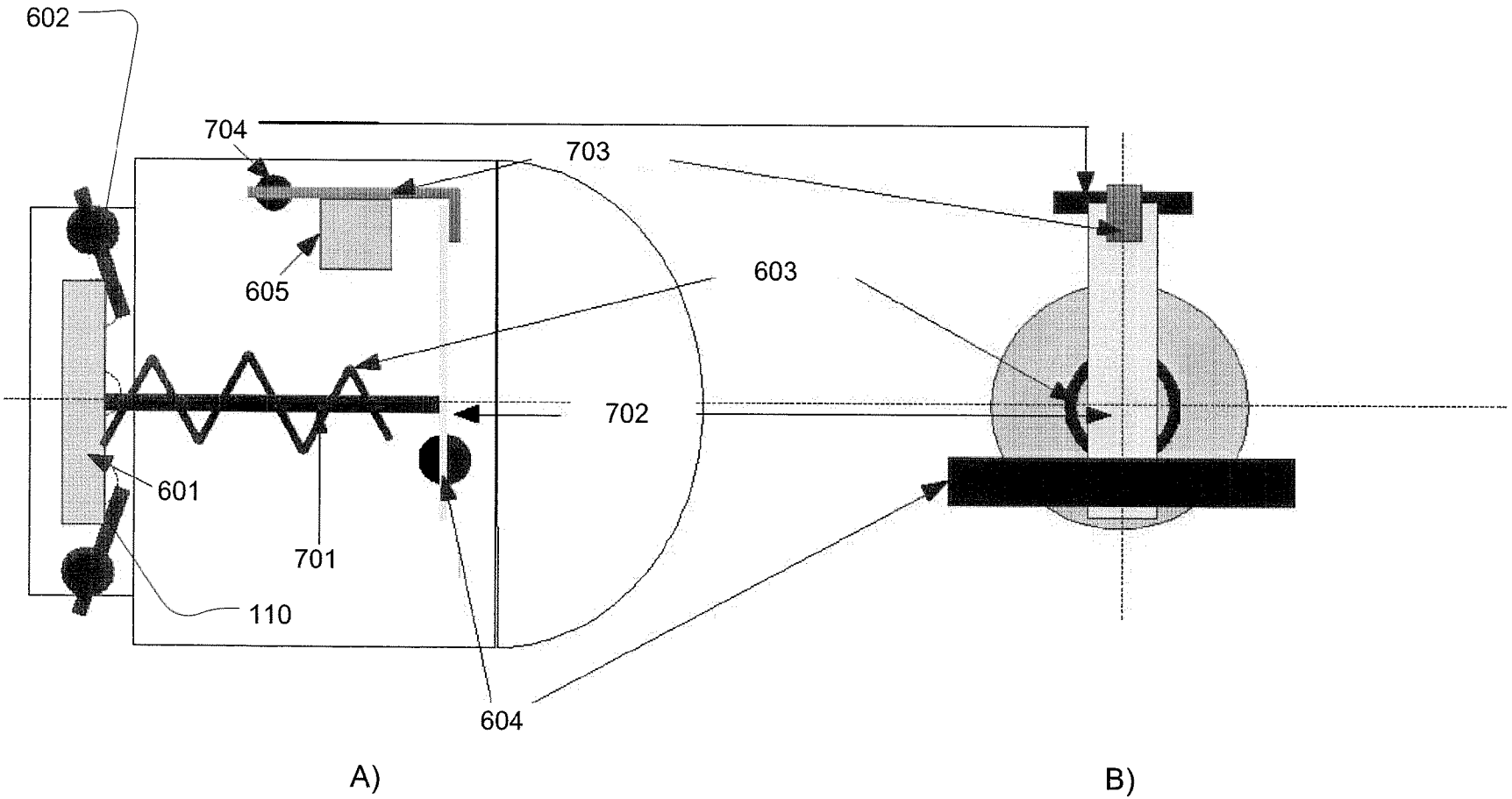
FIG. 7 shows an enlargement of the first part of an embodiment of the device.

FIG. 7 shows an enlargement of the first part 101 of the device 100 of FIG. 6. FIG. 7 A) is a side view of the first part 101 and FIG. 7 B) is a front view. The first part comprises the ball bearings 602, the arms 110, the disc 601, the electro-magnet 605, the spring 603 and the second rotating bar 604. Additionally, the first part comprises a pin 701 attached at one end to the disc 601. The pin is further connected to the spring 603 which may be a pull spring. The spring 603 pulls the pin 701 attached to the disc 601 to the right of FIG. 7. Thereby, the other end of pin 701 pushes on a plate 702. The plate 702 is held in place in one end by a second plate 703 and in the other end by the rotating bar 604. The second plate 703 is held in place by the electro-magnet 605 and one end to a first rotating bar 704 and the other end is holding the first end of the plate 702. Thus, when power to the electro-magnet 605 is terminated, the electro-magnet 605 releases the second plate 703 which rotates around the first rotating bar 704. Thereby, the first end of the plate 702 is released and the plate 702 rotates around the second rotating bar 604 allowing the pin 701 to move to the right of FIG. 7, whereby the disc 601 is moved to the right thus exerting a force on the arms 110. Thereby, the arms 110 and thus also the texture 111 are collapsed.

With the above design, the force required to hold the pin 701 in position is small, e.g. in the order of half a newton.

By being able to decrease the outer diameter of the device 100 via the flexible member 109, the device 100 may adjust its outer diameter according to obstructions in the tubular channel 199. Further, should the device 100 become stuck in a tubular channel 199, e.g. due to a wash-out or the like, the device is able to collapse the flexible member 109 via the means for contracting the flexible member disclosed with respect to FIG. 6 and FIG. 7. In an embodiment, the PLC 180 may be communicatively coupled to the electro-magnet 605. By transmitting a control signal to the electro-magnet 605, the PLC 180 may control the electro-magnet 605 e.g. in the event where the device 100 velocity is zero m/s for a given period e.g. one minute. When receiving the control signal, the electro-magnet may be turned off and thereby collapsing the flexible member as disclosed above.

In an embodiment, the electro-magnet 605 may be replaced by an acid soluble member and the pin 701 may be released by providing contact between the acid soluble member 605 and the plate 703. Thereby, the plate 703 may be etched through whereby the first end of the plate 702 is released and the plate 702 rotates around the second rotating bar 604 allowing the pin 701 to move to the right of FIG. 7, whereby the disc 601 is moved to the right thus exerting a force on the arms 110. Thereby, the arms 110 and thus also the texture 111 are collapsed.

In an embodiment, the device 100 may comprise a mechanical arm which may be used to push the device 100 from a tubular channel 199 wall opposite the direction the device 100 wants to move in.

As an example, the device 100 may be heading towards a wall of the tubular channel 199. The ultrasonic distance sensors transmit data to the PLC which determines that in order to avoid the wall, the upper front nozzle should eject the second fluid. Subsequently, the PLC 180 transmits a control signal indicating how much and/or how long the valve in the valve array 503 controlling the upper front nozzle should open to the valve array 503. When the valve array 503 receives the control signal, the valve fluidly coupled to the upper front nozzle is opened and a jet of second fluid is ejected from the nozzle.

Further, as an example, the device 100 may be heading towards a leg of a fishbone well. The ultrasonic distance sensors transmit data to the PLC which determines that in order to avoid the leg of the fishbone well, the buoyancy of the device 100 should be increased. Subsequently, the PLC 180 transmits a control signal indicating how much and/or how long the valves V1, V2 controlling the fluid coupling between the rubber bellows 402 and the high pressure cylinder 407 should open. When the valves V1, V2 receive the control signal, the valves open according to the control signal and the second fluid from the high pressure cylinder 407 enters the rubber bellows 402 thereby increasing the buoyancy of the device 100.

In an embodiment, the device 100 may be pumped down via the flexible member 109, as disclosed above, a certain length of the tubular channel 199, e.g. the cased part of the tubular channel 199, and from thereof, i.e. in the open hole completion part of the well, the device may propel itself via the nozzles 502, as disclosed above.

In an embodiment, the device 100 may be lowered a certain distance into of the tubular channel 199 by gravity, e.g. until the angle between the tubular channel 199 and vertical exceeds 60 degrees in which the gravitational force in most cases is not high enough to overcome the friction between the fluid and the device 100. From this point of, the device 100 may propel itself via one or more of the above disclosed means e.g. the jet nozzle means 501 and/or the flexible member 109.

In an embodiment, the device 100 may be connected to a tractor which may move a distance into the tubular channel 199, e.g. to an area of interest of a user of the device 100, and subsequently, the device 100 may be released from the tractor in order to propel itself via one or more of the above disclosed means e.g. the jet nozzle means 501 and/or the flexible member 109.

In an embodiment, the device 100 may be connected to a drilling assembly via a wire. The drilling assembly may be positioned in proximity to the external communication unit 102A (e.g. containing the external communication unit 102A) at the surface of the tubular channel 199. Alternatively, the drilling assembly may be positioned in the tubular channel 199.

Figure 8:
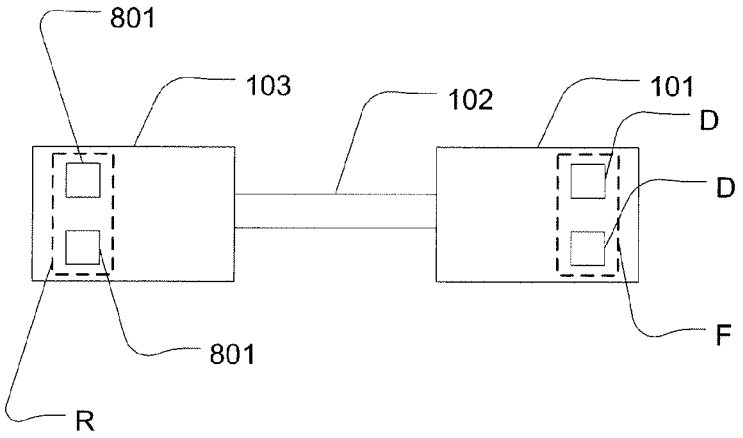
FIG. 8 shows an embodiment of a device for examining a tubular channel comprising a front and a rear array of detectors.

FIG. 8 shows an embodiment of a device 100 for examining a tubular channel comprising a front F and a rear R array of detectors. The device 100 of FIG. 8 may comprise the technical features described under FIGS. 1 and/or 2 and/or 3 and/or 4 and/or 5 and/or 6 and/or 7.

In an embodiment of FIG. 8, each of the front and rear arrays of detectors comprise a number of ultrasonic distance sensors.

The front array of ultrasonic distance sensors F may, for example, comprise the number of ultrasonic distance sensors D contained in the cylindrical part 104 of the first part 101, e.g. in the circumference of the cylindrical part 104 and thereby providing data representing a distance between the cylindrical part 104 and the surrounding tubular channel 199 as disclosed in relation to FIG. 1. For example, the number of ultrasonic distance sensors D may be 10.

The rear array R of ultrasonic distance sensors 801 may comprise a number of ultrasonic distance sensors 801, e.g. 10 ultrasonic distance sensors. The number of ultrasonic distance sensors 801 may provide data representing a distance to e.g. the surrounding tubular channel 199. The ultrasonic distance sensors 801 may be contained within the third part 103. For example, the 10 ultrasonic distance sensors 801 may be contained in a cylindrical part of the third part 103, e.g. in a circumference of the cylindrical part and thereby providing data representing a distance between the cylindrical part and the surrounding tubular channel 199.

The distance between the front F and rear R arrays of ultrasonic distance sensors is known and may, for example be XY mm e.g. 300 mm.

As the device 100 travels in the tubular channel, the front array and the rear array of ultrasonic distance sensors records respective values of the tubular channel. For example, the front and rear array may determine the diameter of the tubular channel.

The front and rear arrays of ultrasonic sensors may be connected to the PLC e.g. via a wire and an analogue-to-digital (A/D) converter and a multiplexer 109.

Further, when the PLC has received a measurement of a diameter of the tubular channel from the front array, it may start a timer such as a clock or the like. When the PLC receives an identical or substantially identical measurement (e.g. 9 out of 10 ultrasonic sensors in the rear array measures similar values as the sensors in the front array), the PLC determines a time-interval between the reception of the front array measurement and the rear array measurement. Based on the distance between the front and rear arrays and the time-interval, the PLC is able to determine a velocity of the device 100 in the tubular channel.

In an embodiment of FIG. 8, each of the front and rear arrays of detectors comprise a number of image sensors. Additionally, the device may comprise a light emitting diode in proximity to each of the image sensors.

The distance between the front F and rear R arrays of image sensors is known and may, for example be XY mm e.g. 300 mm.

For example, the front array may transmit a recorded image to the PLC. The PLC may perform at least one image processing e.g. geometric hashing to determine at least one parameter representative of the image.

Subsequently, the PLC may perform similar image processing on images received from the rear array, and when a match is found between an image from the front array and an image from the rear array, a time-interval between reception of the two images is determined and based on the distance between the front and rear arrays and the time-interval, the PLC is able to determine a velocity of the device 100 in the tubular channel.

In an embodiment, the device 100 may comprise a pitot tube enabling a precise determination of fluid velocity relative to the device 100.

Figure 9:
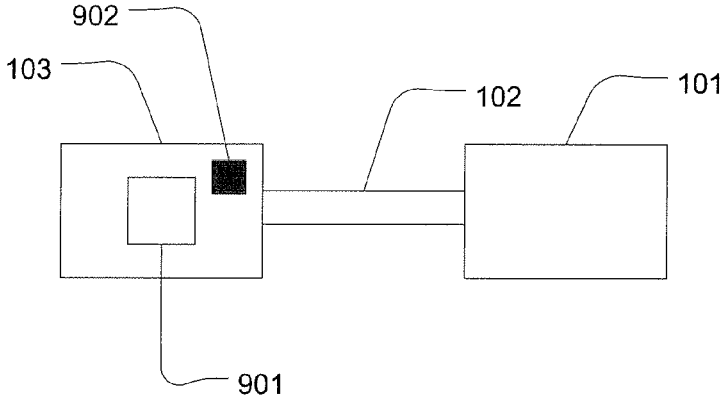
FIG. 9 shows an embodiment of a device for examining a tubular channel comprising a second high pressure cylinder.

FIG. 9 shows an embodiment of a device 100 for examining a tubular channel comprising a second high pressure cylinder 901. The device 100 of FIG. 9 may comprise the technical features described under FIGS. 1 and/or 2 and/or 3 and/or 4 and/or 5 and/or 6 and/or 7 and/or 8.

The high pressure cylinder 901 may contain a gas such as for example nitrogen or the like. Further, the device 100 may be hermetically sealed. Further, the device 100 may be hollow. Additionally further, the second high pressure cylinder may be communicatively coupled to the PLC such that the PLC may control the second high pressure cylinder 901.

The device may further comprise a second pressure sensor 902 communicatively coupled to the PLC.

An external pressure measured by the pressure sensors P and an internal pressure measured by the pressure sensor 902 may be transmitted to the PLC. Based on the difference between the measured pressures, the PLC may control the second high pressure cylinder 901 to emit gas to thereby increase the internal pressure and thus in order to reduce the difference between the measured pressures. In an embodiment, the PLC controls the second high pressure cylinder 901 to emit gas to equalize or substantially equalize (e.g. internal pressure is within 5% of the external pressure) the internal pressure and the external pressure.

By equalizing or substantially equalizing the internal and external pressures enables the walls of the device to be thin and light weight because they are not subjected to a large pressure differential.

Figure 10:
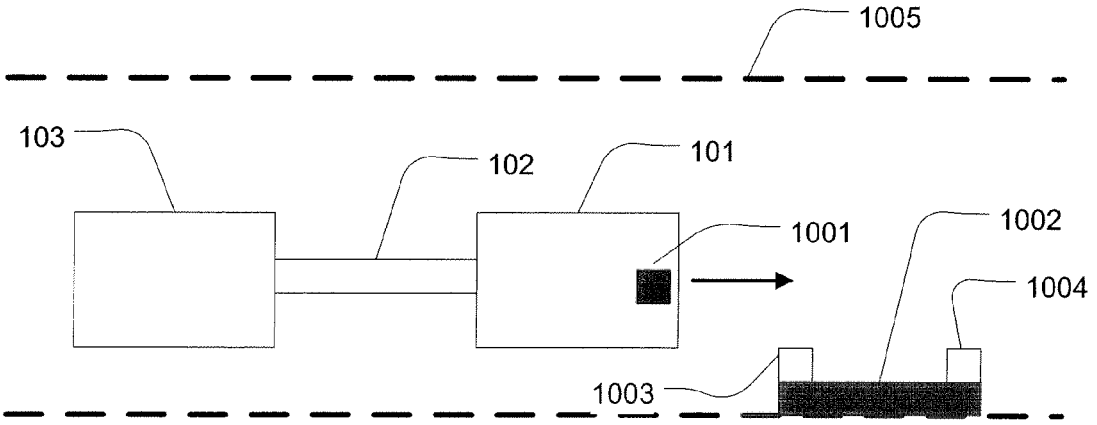
FIG. 10 shows an embodiment of a device for examining a tubular channel comprising a compass.

FIG. 10 shows an embodiment of a device 100 for examining a tubular channel comprising a compass 1001. The device 100 of FIG. 10 may comprise the technical features described under FIGS. 1 and/or 2 and/or 3 and/or 4 and/or 5 and/or 6 and/or 7 and/or 8 and/or 9.

The device 100 may comprise a compass 1001 positioned in the front of the device 100 e.g. in the semi-spherical cap part 105 of the first part 101 as illustrated in FIG. 1. The compass may be communicatively coupled e.g. via an electric wire or Bluetooth to the PLC and may enable detection of e.g. one or more small magnets 1003, 1004 placed in one or more structures contained in the tubular channel.

For example, the structure may be a patch 1002 placed by a tractor in order to prevent water leaking into a hydrocarbon producing well 1005. The patch 1002 may contain a first magnet 1003 e.g. aligned such that the south (S) pole of the magnet is pointing radially into the well and positioned such as to demark the beginning of the patch seen from the entrance of the well. The patch may contain a second magnet 1004 e.g. aligned such that the north (N) pole of the magnet is pointing radially into the well and positioned such as to demark the end of the patch seen from the entrance of the well.

When the device 100 passes the beginning of the patch 1002, the compass 1001 will change its orientation due to the first magnet 1003 and indicate that the device 100 passes a magnetic element e.g. a part of a patch 1002. When the device 100 passes the end of the patch 1002, the compass 1001 will change its orientation due to the presence of the second magnet 1004 and indicate that the device 100 passes a magnetic element e.g. a part of a patch 1002.

In an embodiment, the patch may comprise a number of magnets, e.g. three magnets, in each end in order to be able to provide a specific signal for the beginning and end of the patch. For example, the three magnets placed in the beginning of the patch be aligned such that the south pole of the first magnet, the north pole of the second magnet and the south pole of the third magnet are pointing radially into the well 1005. Additionally, for example, the three magnets placed in the end of the patch 1005 may be aligned such that the north pole of the first magnet, the south pole of the second magnet and the north pole of the third magnet are pointing radially into the well 1005. Thereby, precise identification of the beginning and end of the patch 1005 is possible. Other combinations of number of magnets and alignment of the magnets is possible such as e.g. SSS-poles at the beginning and NNN-poles at the end of the patch.

In an embodiment, the PLC may utilize the information regarding patch beginning and end to e.g. control speed and position of the device 100 in the well.

Figure 11:
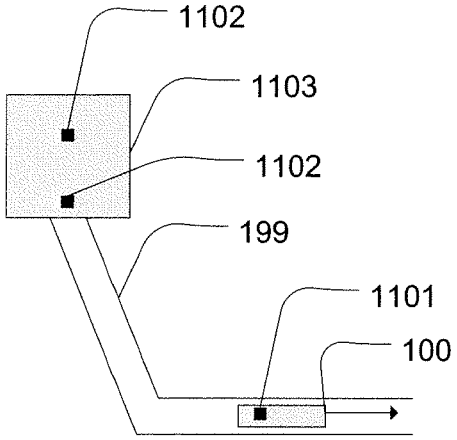
FIG. 11 shows an embodiment of a device for examining a tubular channel comprising a clock.

FIG. 11 shows an embodiment of a device 100 for examining a tubular channel comprising a clock 1101. The device 100 of FIG. 11 may comprise the technical features described under FIGS. 1 and/or 2 and/or 3 and/or 4 and/or 5 and/or 6 and/or 7 and/or 8 and/or 9 and/or 10.

The device may comprise a clock 1101 e.g. contained in the PLC. Another clock 1102 may be contained in a wellhead 1103 positioned at the entrance to the tubular channel 199. Additionally, an ultrasonic transducer 1104 may be placed in the wellhead 1103.

The clock 1101 in the device 100 and the clock 1102 in the wellhead 1103 may be synchronized. Further, the ultrasonic transducer 1104 may be programmed to transmit an ultrasonic signal into the tubular channel 199 towards the device 100 at predetermined time-intervals e.g. 1 minute after the device 100 has left the wellhead, 2 minutes after, etc.

The device 100 may contain a log e.g. in the PLC including information on when the signals are transmitted into the tubular channel 199 by the ultrasonic transducer 1104. Further, the device 100 may determine the time-difference between the time of reception of a signal and the actual transmission time of the signal from the transducer 1104. Knowing the speed of sound in the fluid in which the device is currently moving, the PLC may determine the distance travelled by the device 100 at the time of reception of the signal from the transducer 1104 by multiplying the time-difference with the speed of sound in the fluid. For example, if the time difference between the time of transmission and time of reception of a signal is determined to be 5 seconds and the fluid is water in which the sound speed is approximately 1484 m/s then the device has travelled approximately 7420 m in the tubular channel 199. The device 100 may transmit the distance travelled to the external communication unit 102A via the acoustic modem 108.

In an embodiment, the external communication unit 102A may calculate the velocity of the fluid leaving the well. For example, the external communication unit may know the frequency at which the device 100 transmits (via e.g. the acoustic modem 108) a signal representing the distance travelled by the device 100. Subsequently, the external communication unit 102A may determine the Doppler shift in the frequency of the signal received and from the Doppler shift the velocity of the fluid in which the signal from the device 100 is transmitted may be determined.

The foregoing descriptions of embodiments of the invention have been presented for the purpose of illustration and description only. They are not intended to be exhaustive or to limit the invention to the forms disclosed. Accordingly, many modifications and variations will be apparent to the practitioners skilled in the art. Additionally, the above disclosure is not intended to limit the invention. The scope of the invention is defined by the appended claims.

In general, any of the technical features and/or embodiments described above and/or below may be combined into one embodiment. Alternatively or additionally any of the technical features and/or embodiments described above and/or below may be in separate embodiments. Alternatively or additionally any of the technical features and/or embodiments described above and/or below may be combined with any number of other technical features and/or embodiments described above and/or below to yield any number of embodiments.

In device claims enumerating several means, several of these means can be embodied by one and the same item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. A device for examining a tubular channel, said device comprising:

a buoyancy system configured to adjust a buoyancy of the device, at least one first sensor;

a pressure system configured to generate pressurized fluid or that contains pressurized fluid;

a vent line;

a three-way valve fluidly coupled to the buoyancy system, pressure system and the vent line, wherein the three-way valve controls fluid flow between the pressure system and the buoyancy system and between the buoyancy system and the vent line to thereby adjust the buoyancy of the device; and a processor communicatively coupled to the at least one first sensor and the three-way valve configured to determine the position of the device and to generate a control signal based on data received from the at least one first sensor for controlling the three-way valve via the control signal, to thereby adjust the buoyancy of the device; and at least one second sensor for examining said tubular channel.

2. A device according to claim 1, wherein the buoyancy system is contained in a first part of the device;

the pressure system is contained in a second part of the device;

another buoyancy system is contained in a third part of the device; and wherein the first part and the third part connected via said second part and wherein the second part comprises of two hollow pieces joined via a ball joint.

3. A device according to claim 2, wherein a first of the two hollow pieces comprises a spring and a bar, and wherein one end of the bar is connected to the ball joint and another end of the bar is connected to the spring, which spring is configured to keep the two hollow pieces of the second part in a straight line.

4. A device according to claim 3, wherein the first of the hollow pieces further comprises three cylinders positioned perpendicular to the bar and such as to enable a dislocation of the bar from the straight line.

5. A device according to anyone of claim 2, wherein the ball joint and the bar are hollow, such as to allow the passage of a communicative coupling and/or a fluid coupling.

6. A device according to anyone of claim 1, wherein the device further comprises a plurality of flexible arms having one end connected to the circumference of the device and another end extending radially out from the device at a radius larger than the radius of the device and a maximal outer diameter determined by a texture stretched between the flexible arms.

7. A device according to claim 6, wherein the device is configured to contract the other end of the plurality of flexible arms to a radius of approximately the radius of the device when receiving a control signal from the processor.

8. A device according to claim 6, wherein the communication system is configured to receive the control signal from the external communication unit such as to control the device from the external communication unit.

9. A device according to anyone of claim 1, wherein the device further comprises a plurality of nozzles fluidly coupled to the pressure system such that a pressurized fluid from the pressure system may be ejected via at least one of the plurality of nozzles.

10. A device according to claim 9, wherein the pressure system is fluidly coupled to the plurality of nozzles via a valve array.

11. A device according to claim 10, wherein the processor is configured to control the fluid coupling between the pressure system and the plurality of nozzles via the control signal.

12. A device according to anyone of claim 1, wherein the device further comprises a communication system configured to transmit data from the at least one first sensor to an external communication unit.

13. A device according to anyone of claim 1, wherein the device further comprises a first detector and a second detector, and wherein the first and second detectors are positioned with a fixed distance in between, wherein the device is configured to determine a time difference between reception of a first signal from the first detector and a substantially identical signal from the second detector, and to determine the velocity of the device as the fixed distance divided by the time difference.

14. A device according to anyone of claim 1, wherein the device comprises a clock synchronized with a second clock positioned in connection with a transmitter, wherein the device is configured to receive a signal from the transmitter transmitted at a pre-defined time, and based on a time-difference between the pre-defined time and a time for receiving the signal at the device, and sound-speed in a medium in which the device is, a distance between the transmitter and the device is calculated.

15. A system according to claim 14, wherein the tubular channel is a borehole comprising water or petroleum oil hydrocarbons in fluid form.

16. A system according to claim 14, wherein the device is connected to the tubular channel or a tractor or a drilling assembly.

17. A device according to anyone of claim 1, wherein the device comprises a compass enabling determination of magnetic material containing elements in the tubular channel.

18. A device according to anyone of claim 1, wherein the device comprises a first pressure sensor for measuring a pressure inside the device and second pressure sensor for measuring a pressure outside the device, and a second pressure means configured to pump a gas into the inside of the device, the first and second pressure sensor and the second pressure system being communicatively coupled to the processor such that the processor is able to compensate a pressure difference between the inside and the outside of the device by pumping gas into the inside of the device.

19. A system for examining a tubular channel, the system comprising a tubular channel and a device according to claim 1.

20. The device according to claim 1, wherein said at least one second detector corresponds to one of a: temperature sensor, ohmmeter, ultrasonic sensor, ultrasonic distance sensor, and image senor.

21. The device according to claim 20, wherein said buoyancy system is arranged at a first end of said device, and another buoyancy system is arranged at a second end of said device that is opposite the first end of the device.

22. The device according to claim 1, wherein said buoyancy system is arranged at a first end of said device, and another buoyancy system is arranged at a second end of said device that is opposite the first end of the device.

23. A method of examining a tubular channel by a device said method comprising:

establishing a communicatively coupling between processor and at least one first sensor and between the processor and a three-way valve;

generating, by the processor, a control signal based on data received from the at least one first sensor;

fluidly coupling a pressure system to a buoyancy system, configured to adjust the buoyancy of the device, via the three-way valve such that a fluid may flow from the pressure system to the buoyancy system or from the buoyancy system to the surroundings of the device via a vent line;

controlling the three-way valve by the processor via the control signal such that fluid flow between the pressure system and the buoyancy system and between the buoyancy system and the vent line is controlled via the three-way valve; and providing at least one second sensor for examining said tubular channel.

* * * * *